US007111354B2

(12) United States Patent
Nennig et al.

(10) Patent No.: US 7,111,354 B2
(45) Date of Patent: Sep. 26, 2006

(54) APPARATUS FOR APPLYING A LIQUID COATING ONTO AN OBJECT

(75) Inventors: Catherine A. Nennig, Neenah, WI (US); James A Cotter, II, Waupaca, WI (US); Bruce Siebers, Kimberly, WI (US); Julie M. Bednarz, Neenah, WI (US); Fung-jou Chen, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 87 days.

(21) Appl. No.: 10/837,033

(22) Filed: Apr. 30, 2004

(65) Prior Publication Data

US 2005/0241097 A1 Nov. 3, 2005

(51) Int. Cl.
*A46B 17/00* (2006.01)
*A46B 17/04* (2006.01)

(52) U.S. Cl. ..... 15/248.1; 15/247; 206/361; 206/15.3

(58) Field of Classification Search ..... 15/247, 15/248.1, 248.2; 206/361, 15.2, 15.3, 209; 150/154

See application file for complete search history.

(56) References Cited

U.S. PATENT DOCUMENTS

| | | | |
|---|---|---|---|
| 3,633,234 | A | 1/1972 | Henningsen |
| 3,690,448 | A | 9/1972 | Switzer |
| 3,733,638 | A | 5/1973 | Kaplan |
| 3,783,468 | A | 1/1974 | Saloutos |
| 3,883,897 | A | 5/1975 | Lefkowitz |
| 3,905,476 | A | 9/1975 | Foreman |
| 3,937,583 | A | 2/1976 | Tyson et al. |
| 3,955,670 | A | 5/1976 | Buslik |
| 3,970,396 | A | 7/1976 | Brady |
| 3,981,399 | A | 9/1976 | Crouch |
| 4,010,510 | A | 3/1977 | Belza |
| 4,020,520 | A | 5/1977 | Dellas |
| 4,155,139 | A | 5/1979 | Corcoran |
| 4,165,942 | A | 8/1979 | Johansson |
| 4,166,304 | A | 9/1979 | Flynn |
| D256,190 | S | 8/1980 | Janssen |
| 4,295,241 | A | 10/1981 | Woolcock |
| 4,299,006 | A | 11/1981 | Cruz |
| 4,339,837 | A | 7/1982 | Reeberg |

(Continued)

FOREIGN PATENT DOCUMENTS

| | | |
|---|---|---|
| DE | 3622462 | 1/1988 |

(Continued)

*Primary Examiner*—Gladys JP Corcoran
*Assistant Examiner*—Laura C Guidotti
(74) *Attorney, Agent, or Firm*—Schwegman, Lundberg, Woessner, & Kluth, P.A.

(57) ABSTRACT

The present invention relates to an apparatus for applying a liquid coating onto an object. The apparatus includes a device that has a handle and a transfer medium which is attached to the handle. The apparatus further includes a cover that is attached to the device. The cover includes a closure element that is operable to open and close an end of the cover. When the end of the cover is open, the cover is movable between a first position where the cover protects the transfer medium and a second position where the cover protects the handle. In another example embodiment, the cover is formed of a removable first layer that is positioned adjacent to the transfer medium when the cover is in the first position and a removable second layer that is positioned adjacent to the handle when the cover is in the second position.

12 Claims, 10 Drawing Sheets

U.S. PATENT DOCUMENTS

| | | | | |
|---|---|---|---|---|
| 4,409,372 | A | | 10/1983 | Ward et al. |
| 4,466,151 | A | | 8/1984 | Barch et al. |
| 4,469,223 | A | | 9/1984 | Smith |
| 4,471,507 | A | | 9/1984 | Schwartz |
| 4,494,268 | A | | 1/1985 | Chu |
| 4,533,044 | A | | 8/1985 | Ban |
| 4,590,637 | A | | 5/1986 | Marion |
| 4,735,522 | A | | 4/1988 | Myun-Sik |
| 4,751,762 | A | | 6/1988 | Meimeteas |
| 4,903,869 | A | | 2/1990 | McKenna |
| 5,022,112 | A | | 6/1991 | Burns |
| 5,032,188 | A | | 7/1991 | Kettle et al. |
| 5,071,278 | A | | 12/1991 | Chen |
| 5,084,932 | A | | 2/1992 | Zanchi |
| 5,146,646 | A | | 9/1992 | Langford et al. |
| 5,174,445 | A | | 12/1992 | Mull |
| 5,218,733 | A | | 6/1993 | Leu |
| 5,244,090 | A | | 9/1993 | Keith |
| 5,701,629 | A | | 12/1997 | O'Brien |
| 5,709,301 | A | | 1/1998 | Couch et al. |
| 5,778,479 | A | | 7/1998 | Raia |
| 5,992,617 | A | | 11/1999 | Couch et al. |
| 6,131,731 | A | * | 10/2000 | Wooley ..... 206/207 |
| D439,748 | S | | 4/2001 | Woodnorth et al. |
| 6,450,336 | B1 | | 9/2002 | Edes |
| 6,530,107 | B1 | | 3/2003 | Kim |
| 6,757,931 | B1 | * | 7/2004 | Nordstrom ..... 15/248.1 |
| 2003/0135945 | A1 | | 7/2003 | Nordstrom |
| 2005/0145518 | A1 | * | 7/2005 | Hong ..... 206/361 |

FOREIGN PATENT DOCUMENTS

| | | | |
|---|---|---|---|
| DE | 3622462 | A1 | 1/1988 |
| DE | 3622462 | C2 | 6/1989 |
| EP | 0190369 | A1 | 8/1986 |
| EP | 0272838 | A1 | 6/1988 |
| EP | 0443261 | B1 | 8/1991 |
| EP | 1147724 | A2 | 10/2001 |
| GB | 581267 | | 10/1946 |
| GB | 2395897 | | 6/2004 |

* cited by examiner

APPARATUS FOR APPLYING A LIQUID COATING ONTO AN OBJECT

FIELD

Some embodiments of this invention relate to an apparatus for applying a liquid coating onto an object, and in particular to such an apparatus that includes a device having a transfer medium which can be preserved between uses of the apparatus.

BACKGROUND

There are several devices that are typically used to apply a liquid coating onto an object. As examples, brushes, rollers, mops and pads are often used to apply a paint, stain, waxes, cleaning materials and/or cooking materials (among other materials) onto surfaces of an object.

These devices may be relatively costly such it may be desirable to try to preserve the devices for reuse at a later time. In order to preserve a device that is used to apply a liquid coating, virtually all of the liquid (e.g., paint) needs to be removed from the device before it can be set aside. The extensive cleaning that is typically required to remove all of the liquid from such a device is often tedious, dirty and time-consuming.

Depending on the type of liquid that is applied onto an object, a solvent is often required to clean a device. Many solvents are harmful to the skin and/or emit vapors that may have varying degree of toxicity. These solvents are also typically costly to purchase and difficult to dispose of after use.

One method of preserving a device that is used to apply a liquid coating onto an object is to store the device in a container of the liquid, or another type of solvent, where the device remains until the next time the device is used. However, if the interval between uses is relatively long, some of the liquid or solvent may evaporate, or harden, causing the device to be irreparably damaged.

There is a need for an apparatus for applying a liquid coating to an object where the apparatus can be used to apply liquid onto an object at more than one time. The apparatus should also be able to provide a somewhat environmentally amenable method to dispose of the apparatus. It would also be desirable if the apparatus were able to provide protection to an individual's hand as the individual uses the apparatus to apply liquid to an object.

SUMMARY OF THE INVENTION

The present invention relates to an apparatus for applying a liquid coating onto an object. The apparatus includes a device that has a transfer medium which is protected by a cover between uses so that the apparatus may be used more than once without having to clean the transfer medium.

In one example embodiment, the apparatus includes a device that has a handle and a transfer medium which is attached to the handle. The apparatus further includes a cover that is attached to the device. The cover includes a closure element that is operable to open and close an end of the cover. When the end of the cover is open, the cover is movable between a first position where the cover protects the transfer medium and a second position where the cover protects the handle. The cover may provide an air tight environment in which to store the transfer medium on the device when the closure element closes the end of the cover. Storing the transfer medium in an air tight environment may allow the device to be used on more than occasion to apply a liquid coating to an object without having to clean the device. In addition, providing an air tight environment inhibits the spread of odors from the transfer medium.

In another example embodiment, the apparatus includes a device that has a handle and a transfer medium which is attached to the handle. The apparatus further includes a cover that is attached to the device. The cover includes an open end such that the cover is movable between a first position where the cover protects the transfer medium and a second position where the cover protects the handle. The cover is formed of a first layer that is positioned adjacent to the transfer medium when the cover is in the first position and a second layer that is positioned adjacent to the handle when the cover is in the second position. The first layer is removable such that the second layer is adjacent to the transfer medium when the cover is in the first position and the first layer is removed. When the cover is in the second position, the cover may protect a hand of an operator that uses the apparatus to apply a liquid coating onto an object. In addition, the first layer of the cover may be removed from the device when the first layer becomes messy making it easier to keep the device cleaner between uses.

In still another example embodiment, the apparatus includes a device that has a handle and a transfer medium which is attached to the handle. The apparatus further includes a cover that is attached to the device. The cover includes a closure element that is operable to open and close an end of the cover. When the end of the cover is open, the cover is movable between a first position where the cover protects the transfer medium and a second position where the cover protects the handle. The cover is formed of a first layer that is positioned adjacent to the transfer medium when the cover is in the first position and a second layer that is positioned adjacent to the handle when the cover is in the second position. The first layer is removable such that the second layer is adjacent to the transfer medium when the cover is in the first position and the first layer is removed. The transfer medium may be stored in an air tight environment within the cover when the closure element closes the end of the cover. Storing the transfer medium in an air tight environment when it is laden with liquid provides a more environmentally amenable condition in which to dispose of the apparatus. In addition, the cover maintains the transfer medium in a sanitary environment that keeps the transfer medium from becoming contaminated with other materials.

The purposes and features of the present invention will be set forth in the description that follows. Additional features of the invention will be realized and attained by the product and processes particularly pointed out in the written description and claims hereof, as well as from the appended drawings.

BRIEF DESCRIPTION OF THE DRAWINGS

The present invention will be more fully understood, and further features will become apparent, when reference is made to the following detailed description and the accompanying drawings. The drawings are merely representative and are not intended to limit the scope of the claims. Like parts depicted in the drawings are referred to by the same reference numerals.

DETAILED DESCRIPTION OF THE INVENTION

In the following detailed description, reference is made to the accompanying drawings, which show specific embodiments in which the invention may be practiced. These embodiments are described in sufficient detail to enable those skilled in the art to practice the invention. It is to be understood that other embodiments may be utilized and structural changes made, such that the following detailed description is not to be taken in a limiting sense.

Figure 1:
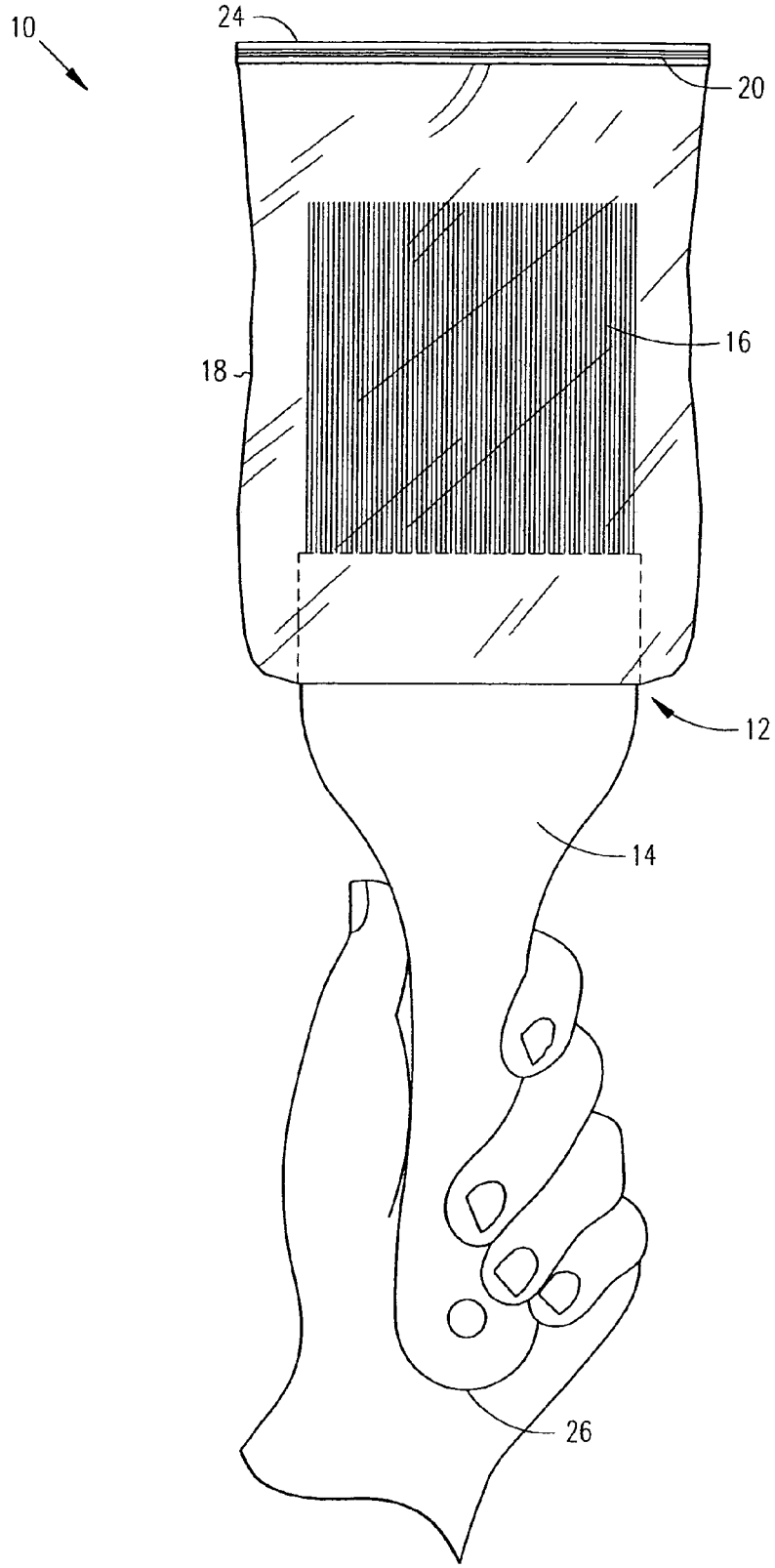
FIG. 1 is a perspective view of an example apparatus for applying a liquid coating onto an object with an end of a cover on the apparatus closed and the cover in a first position.
Figure 2:
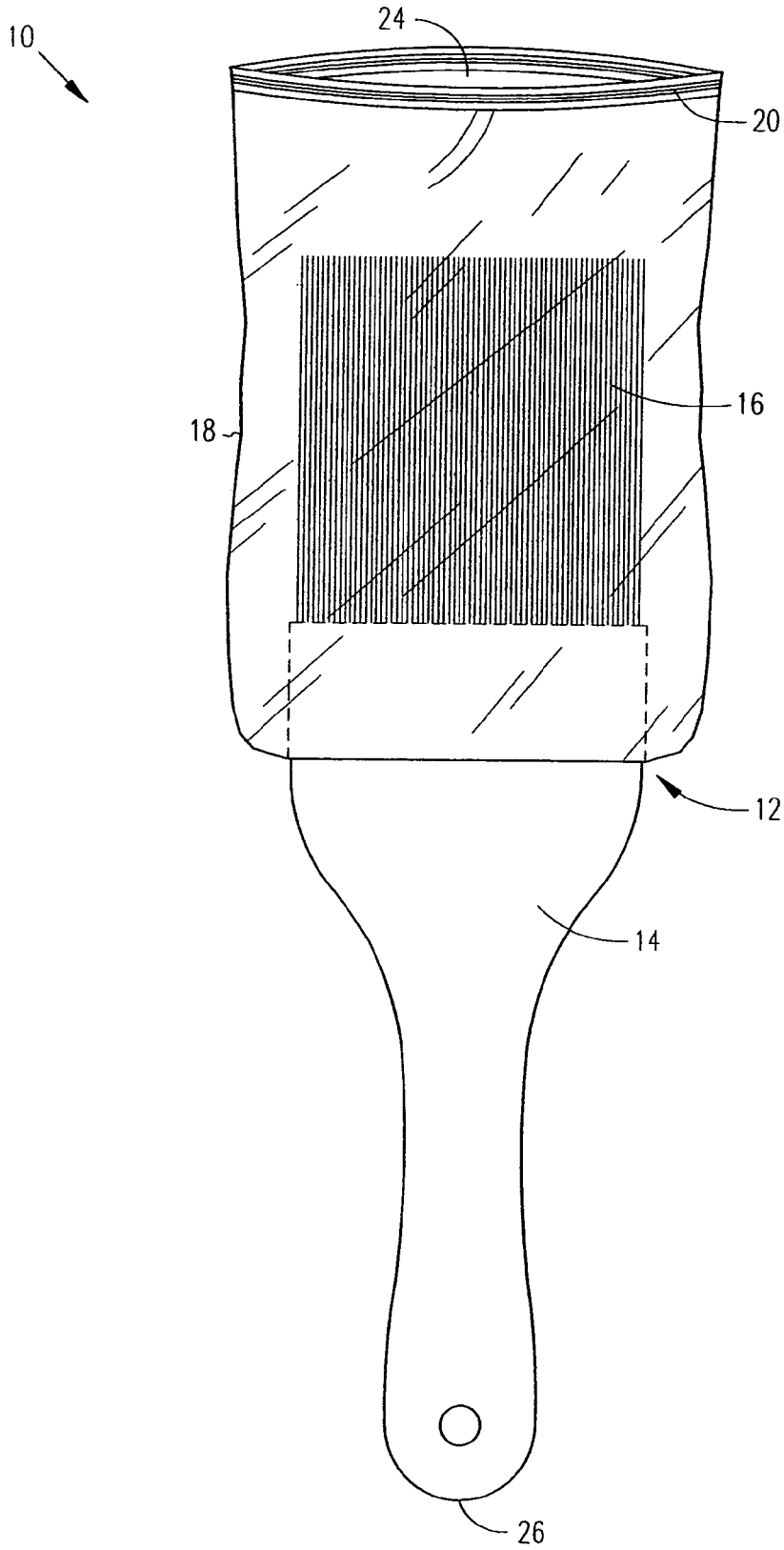
FIG. 2 is a perspective view of the apparatus shown in FIG. 1 with the end of the cover on the apparatus open and the cover in the first position.
Figure 3:
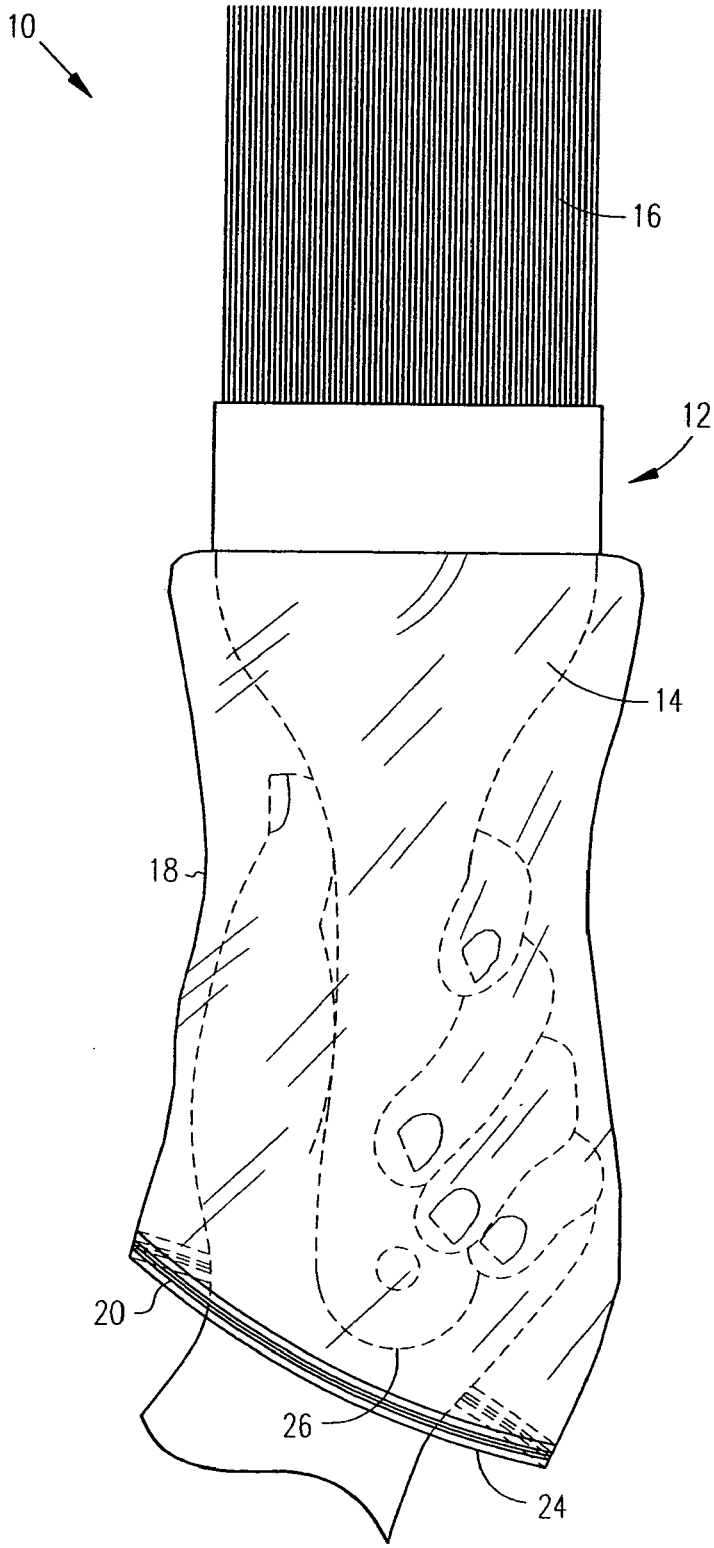
FIG. 3 is a perspective view of the apparatus shown in FIG. 2 with the end of the cover on the apparatus open and the cover in a second position.

FIGS. 1–3 illustrate an apparatus 10 for applying a liquid coating onto an object. The apparatus 10 includes a device 12 that has a handle 14 and a transfer medium 16 which is attached to the handle 14. The apparatus 10 further includes a cover 18 that is attached to the device 12.

The cover 18 includes a closure element 20 that is operable to close (FIG. 1) and open (FIG. 2) an end 24 of the cover 18. When the end 24 of the cover 18 is open, the cover 18 is movable between a first position (FIG. 2) where the cover 18 protects the transfer medium 16 and a second position (FIG. 3) where the cover 18 protects the handle 14.

When an operator uses the apparatus 10 to apply a liquid coating onto an object, the operator initially moves the closure element 20 to open the end 24 of the cover 18. The operator then moves the cover 18 to the second position where the cover 18 provides protection to the operator's hand as the operator applies liquid to the object with the apparatus 10. In some forms, the cover 18 extends past an end 26 of the handle 14 when the cover 18 is in the second position such that the cover 48 may also protect the operator's wrist and arm depending on how far the cover 18 extends past the end 26 of the handle 14. Once the operator finishes working, the operator moves the cover 18 back to the first position. The operator then moves the closure element 20 to close the end 24 of the cover 18 such that the cover 18 again protects the transfer medium 16.

In the illustrated example embodiment, the device 12 is a paint brush such that the transfer medium 16 is bristles. It should be noted that many other devices are contemplated for the device 12. Some other example devices that may be used to apply a liquid to an object include rollers, pads, mops, sponges and swabs (among others).

As used herein, transfer medium 16 may includes bristles, sponges, woven or non-woven fabrics, cellulose-based materials, polymers, rubbers, fibrous materials, or any other absorbent media. It should be noted that the transfer medium 16 may include any material that can apply a liquid coating onto an object.

The handle 14 may be any made from any material that adequately supports the device 12. Some example materials for the handle 14 include wood and plastic (among others). The proper size, shape and material of the handle 14 will depend on the type of device 12 that is included in the apparatus 10 as well as the application where the apparatus 10 is used. It should be noted that the handle 14 may be formed from a combination of two or more materials and/or a combination of one or more pieces.

FIGS. 1–3 illustrate the closure element 20 as a zipper lock, although other items may be used to seal the end 24 of the cover 18. Some example closure elements include a drawstring, elastic band, adhesives, tapes, clamps, buttons, wire ties, magnetic elements and mechanical fasteners (e.g., hook and loop) among other closure elements. In some embodiments, the closure element 20 may be a resilient elastic band that closes when the cover 18 is in the first position and clamps the hand, wrist or arm of an operator that is using the apparatus 10 when the cover 18 is in the second position. It should be noted that the closure element 20 may not necessarily provide an air tight environment.

The closure element 20 may also place the apparatus 10 in a somewhat more environmentally amenable condition for disposal when the operator wants to discard the apparatus 10. In some forms, the cover 18 may provide an air-tight seal when the closure element 20 closes the end 24 of cover 18. Therefore, the cover 18 may be able to enclose the transfer medium 16 and any liquid contained on the transfer medium 16.

It should be noted the cover 18 may be any made from any material that provides protection to the transfer medium 16. Some example materials for the cover 18 include nonwoven laminates, plastic films (breathable and non-breathable), coated or impregnated papers (among others). The proper size, shape and material of the cover 18 will depend on the type of device 12 that is included in the apparatus 10 as well as the application where the apparatus 10 is used. It should be noted that the cover 18 may be formed from a combination of two or more materials.

In the illustrated example embodiment, the cover 18 is attached to the device 12 between the handle 14 and the transfer medium 16, although it should be noted that the cover 18 may be attached to any part of the device 12. In addition, the cover 18 may be attached to the device 12 using an adhesive (or some other fastener). As examples, the cover 18 may be pressed between the handle 14 and the transfer medium 16, or adhered to a surface of the handle 14 using an adhesive tape. The scope of the invention is not limited to how the cover 18 is attached the device 12.

In some embodiments, the cover 18 may be transparent so that the condition of the transfer medium 16 may be observed by an operator when the transfer medium 16 is stored within the cover 18. A transparent cover 18 may allow the operator to inspect the transfer medium 16 before attempting to reuse the device 12, and if the condition of the transfer medium 16 appears unsatisfactory, the operator may decide to dispose of the apparatus 10.

In other embodiments, the cover 18 may be opaque so that condition of the transfer medium 16 may be hidden from view when the transfer medium 16 is stored within the cover 18. As an example, a mop head may be hidden from view within the cover 18 in between uses to prevent anyone from looking at such a filthy object.

Figure 4:
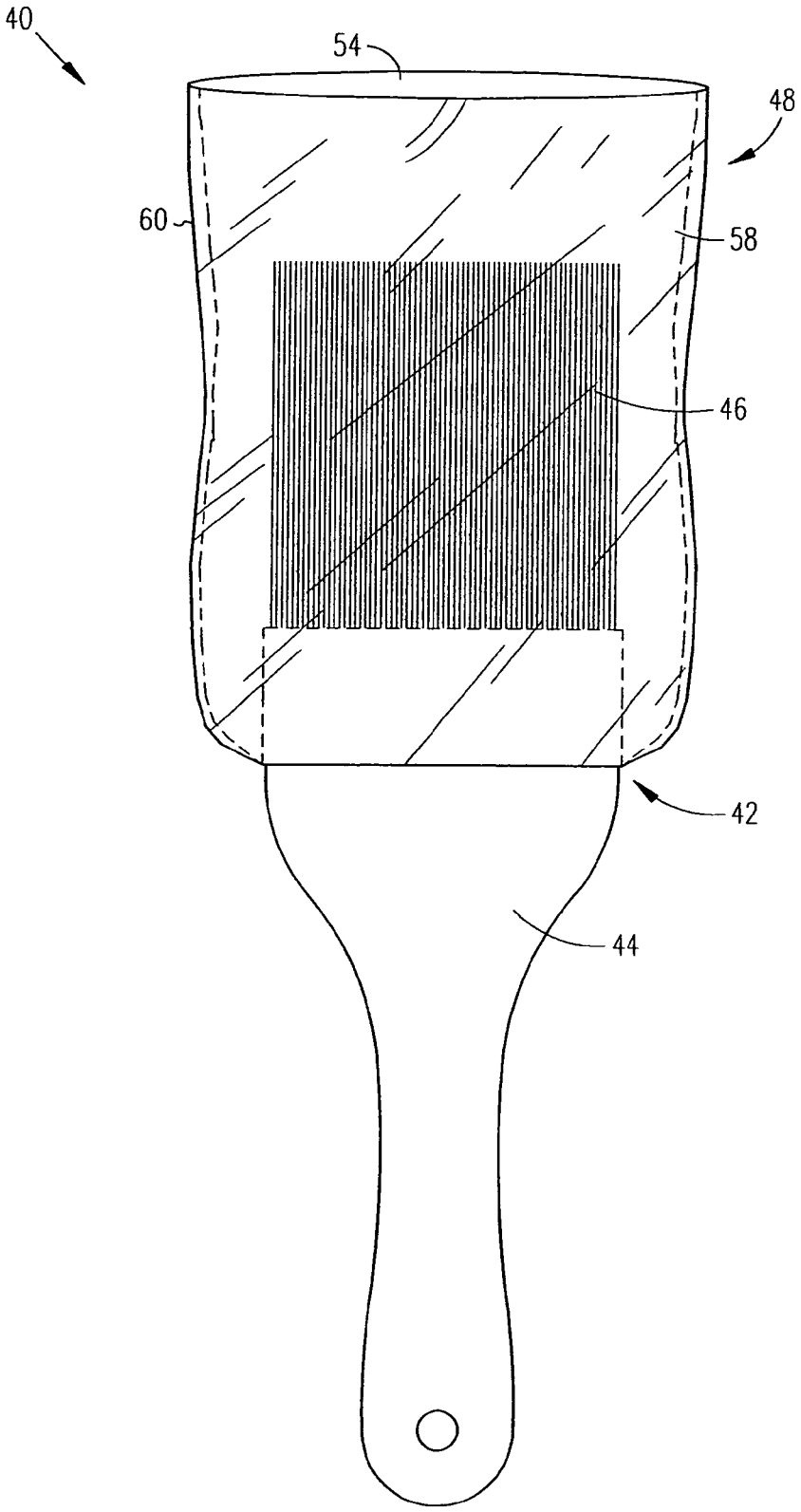
FIG. 4 is a perspective view of another example apparatus for applying a liquid coating onto an object with a cover on the apparatus in a first position.
Figure 5:
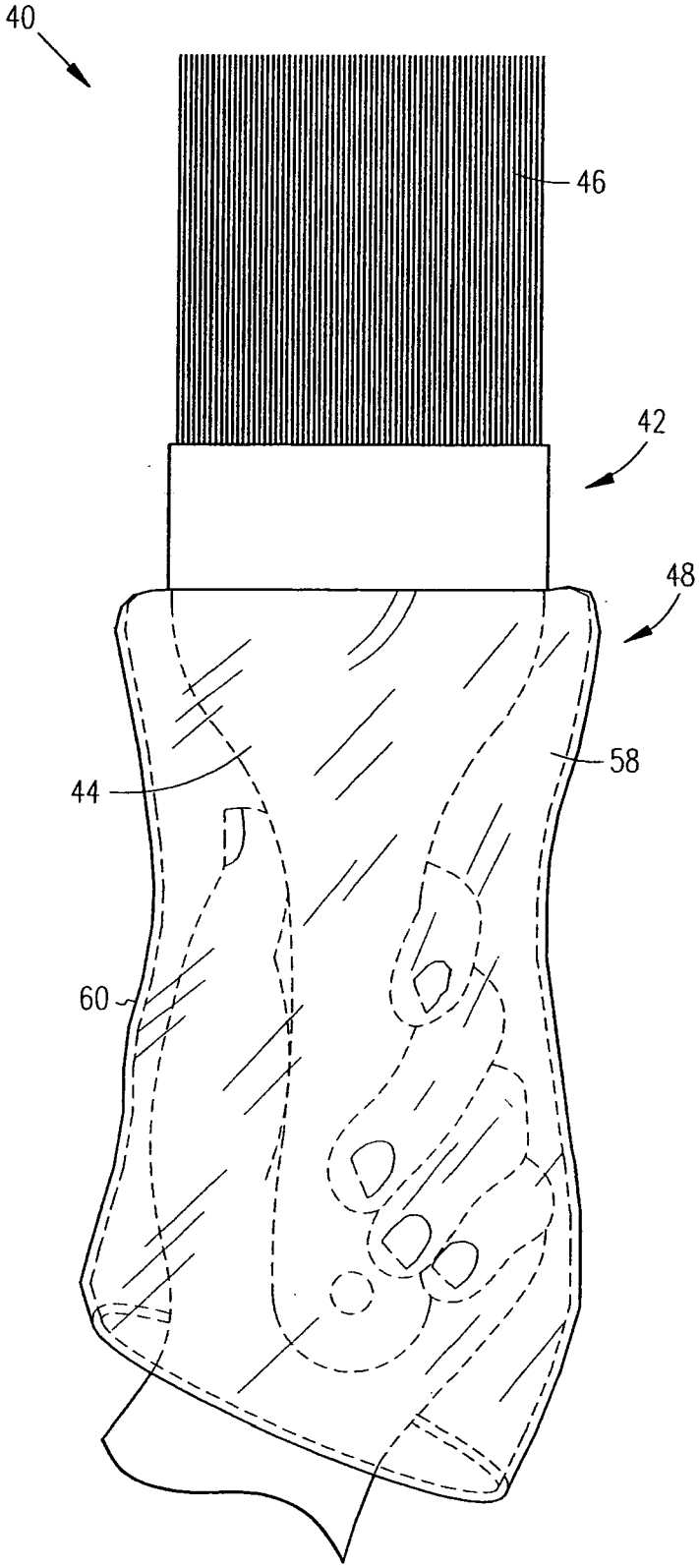
FIG. 5 is a perspective view of the apparatus shown in FIG. 4 with the cover on the apparatus in a second position.
Figure 6:
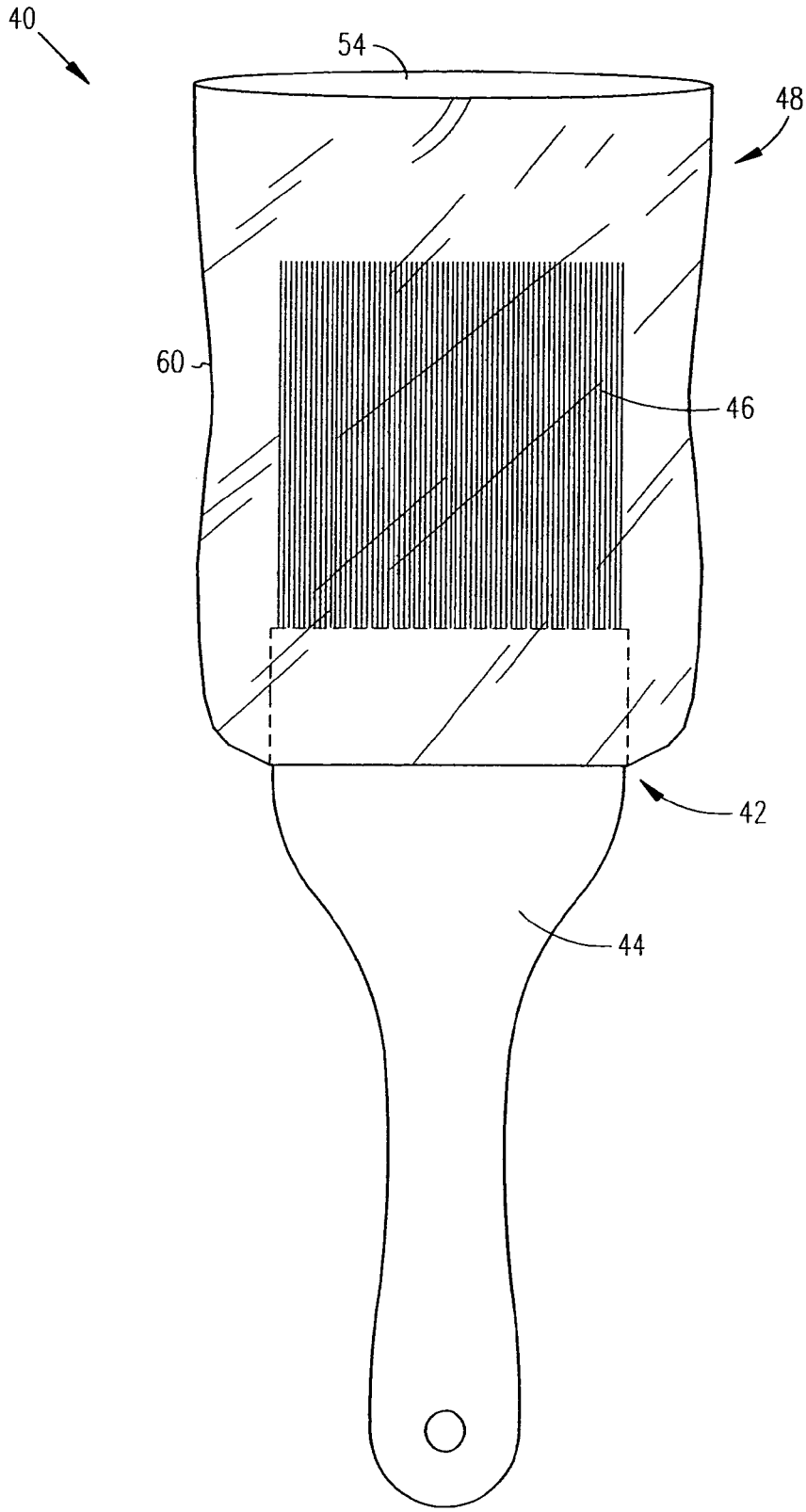
FIG. 6 is a perspective view of the apparatus shown in FIG. 5 with the cover on the apparatus back in the first position and a first layer of the cover removed.
Figure 7:
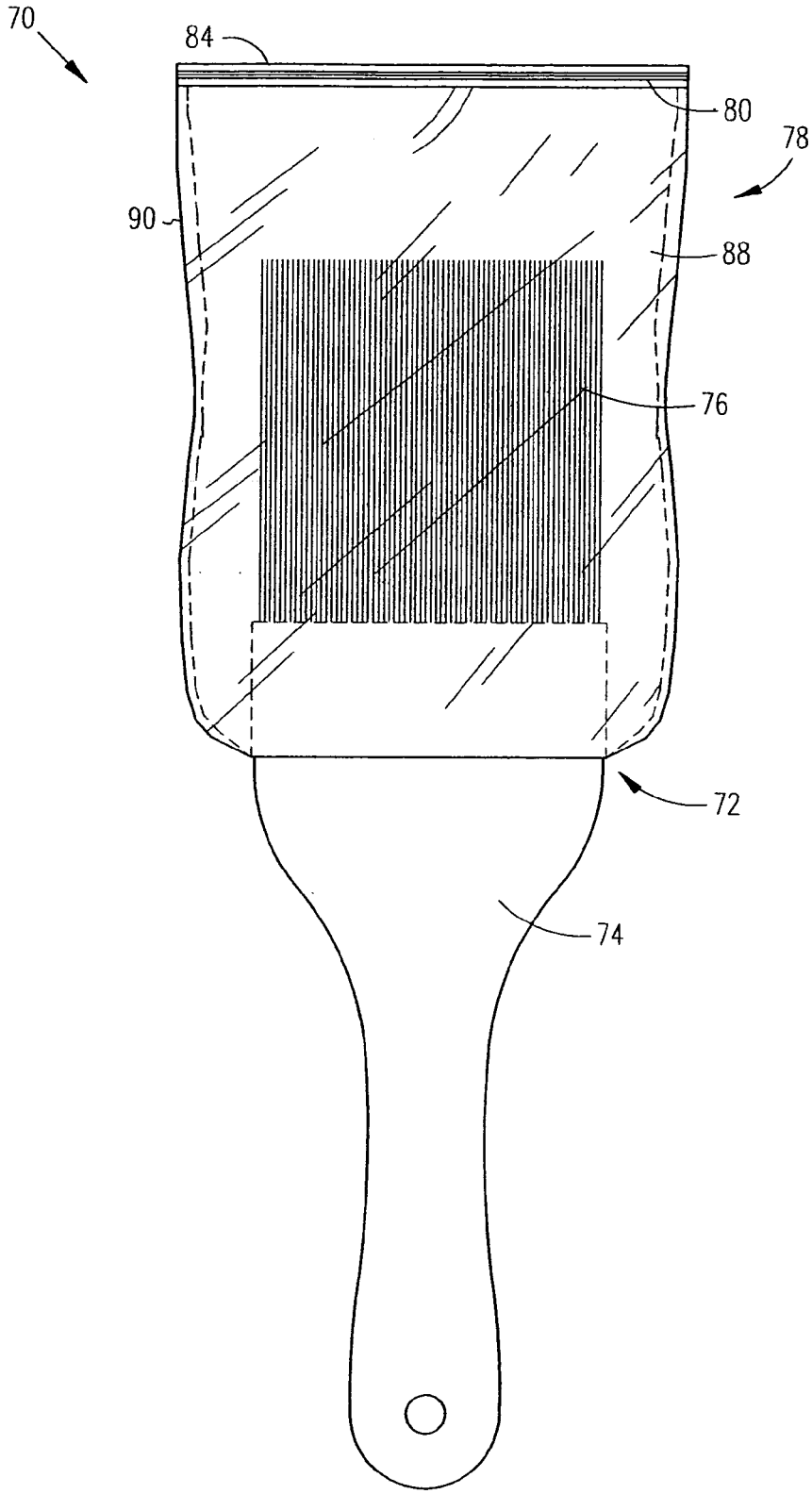
FIG. 7 is a perspective view of another example apparatus for applying a liquid coating onto an object with an end of a cover on the apparatus closed and the cover in a first position.
Figure 8:
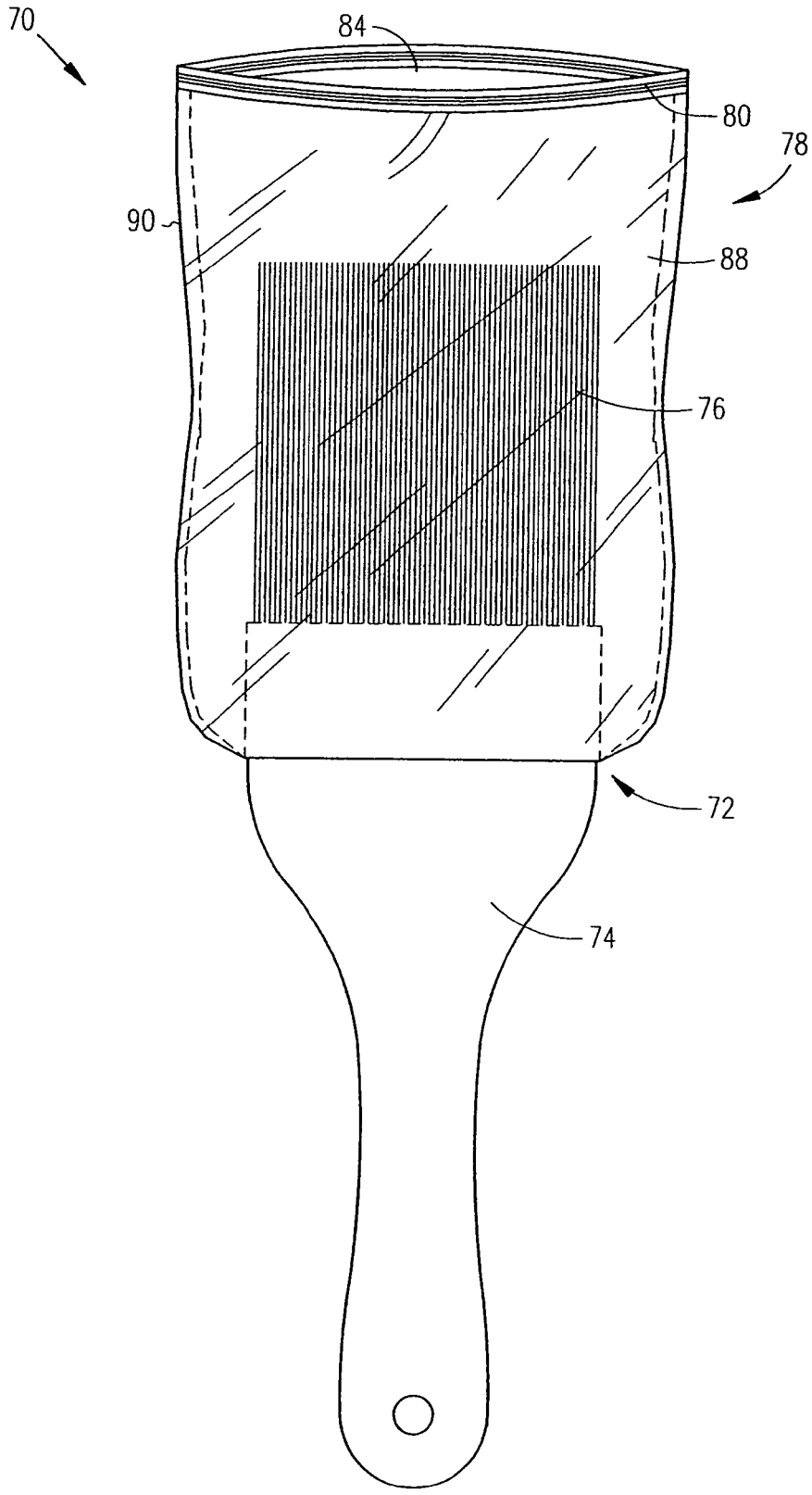
FIG. 8 is a perspective view of the apparatus shown in FIG. 7 with the end of the cover on the apparatus open and the cover in the first position.

FIGS. 4–6 illustrate an apparatus 40 for applying a liquid coating onto an object. The apparatus 40 includes a device 42 that has a handle 44 and a transfer medium 46 which is attached to the handle 44. The apparatus 40 further includes a cover 48 that is attached to the device 52. The device 42 may be similar to any of the devices 12 described above with regard to FIGS. 1–3.

The cover 48 includes an open end 54 such that the cover 48 is movable between a first position (FIG. 4) where the cover 48 protects the transfer medium 46 and a second position (FIG. 5) where the cover 48 protects the handle 44. The cover 48 is formed of a first layer 58 that is positioned adjacent to the transfer medium 46 when the cover 48 is in the first position and a second layer 60 that is positioned adjacent to the handle 44 when the cover 48 is in the second position. As shown in FIG. 6, the first layer 58 is removable such that the second layer 60 is positioned adjacent to the transfer medium 46 when the cover 48 is in the first position and the first layer 58 is removed from the device 42.

When an operator uses the apparatus 40 to apply a liquid coating onto an object, the operator moves the cover 48 to the second position such that the cover 48 protects an operator's hand as the operator applies liquid to the object with the apparatus 40. Once the operator finishes working, the operator moves the cover 48 back to the first position such that the cover 48 protects the transfer medium 46.

When the operator needs to reuse the apparatus 50, the operator moves the cover 48 back to the second position and removes the messy first layer 58 from the device 42 such that the cover 48 again provides protection to the operator's hand as liquid is applied to the object. Once the operator finishes working again, the operator moves the cover 48 back to the first position such that second layer 60 is adjacent to the transfer medium 46 and the cover 48 protects the transfer medium 46.

The first and second layers 58, 60 of the cover 48 may be any made from any material that provides protection to the transfer medium. The first layer 58 may be formed of the same material as the second layer 60 or a different material. In addition, the first and second layers 58, 60 of the cover 48 may be transparent to observe the condition of the transfer medium 46 when the transfer medium 46 is protected by the cover 48.

It should be noted that the first and second layers 58, 60 of the cover 48 may be attached to the device 42 via any method previously described herein. In some embodiments, the first layer 58 and/or the second layer 60 of the cover 48 may include a perforated section that facilitates removing the first layer 58 and/or the second layer 60 from the device 42.

In some embodiments, the cover 48 may include multiple layers such that individual layers may be removed from the device in order to keep the device relatively clean between uses. Some the layers may include perforated sections that facilitate the removing the layers from the device.

FIGS. 7–10 show an example apparatus 70 for applying a liquid coating onto an object. The apparatus 70 includes a device 72 that has a handle 74 and a transfer medium 76 which is attached to the handle 74. The device 72 may be similar to any of the other devices already described herein. The apparatus 70 further includes a cover 78 that is attached to the device 72 in a manner that is similar to the other embodiments already described herein.

The cover 78 includes a closure element 80 that is operable to close (FIG. 7) and open (FIG. 8) an end 84 of the cover 78. The closure element 80 may be similar to any of the closure elements previously described herein. When the end 84 of the cover 78 is open, the cover 78 is movable between a first position (FIG. 8) where the cover 78 protects the transfer medium 76 and a second position (FIG. 9) where the cover 78 protects the handle 74.

Figure 9:
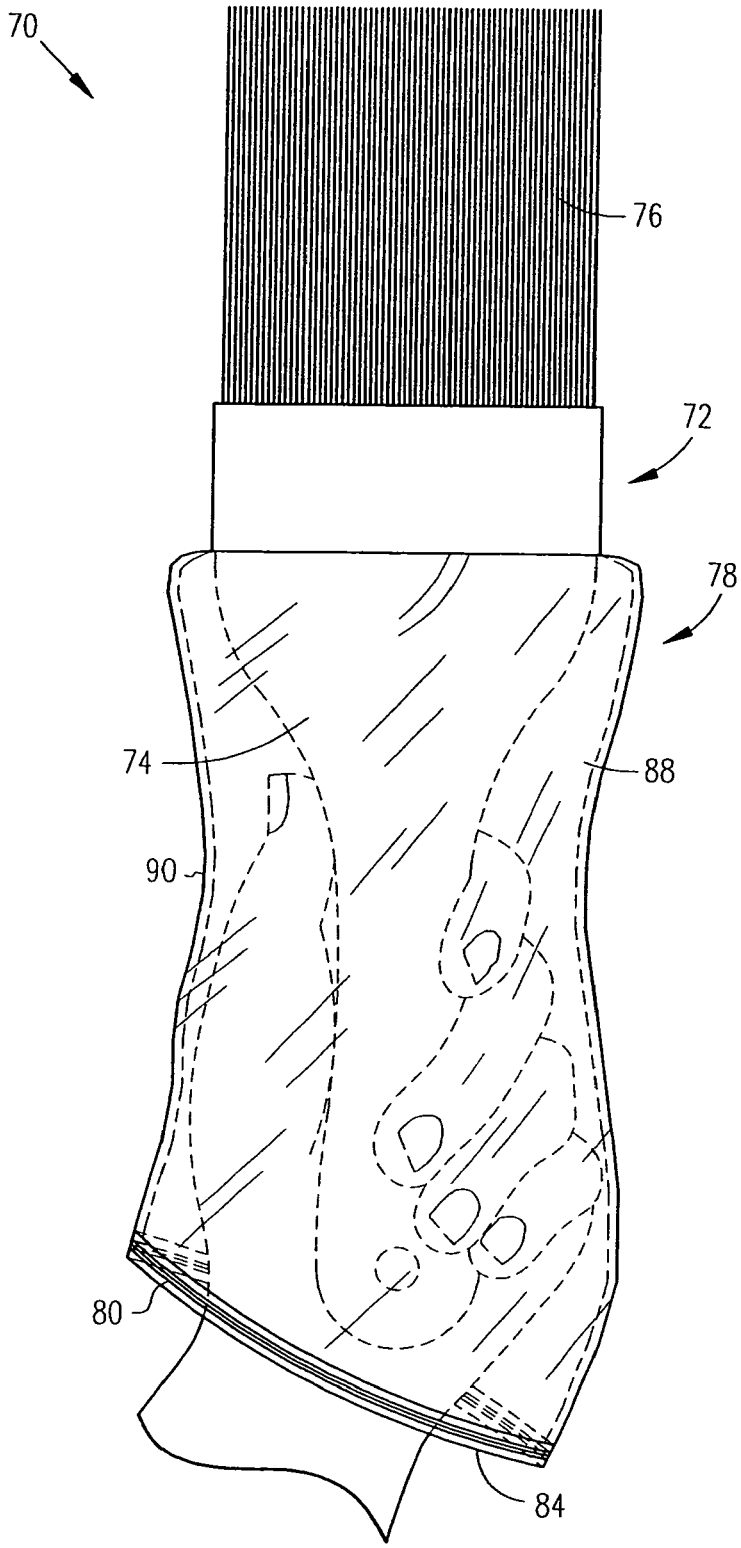
FIG. 9 is a perspective view of the apparatus shown in FIG. 8 with the cover on the apparatus in a second position.
Figure 10:
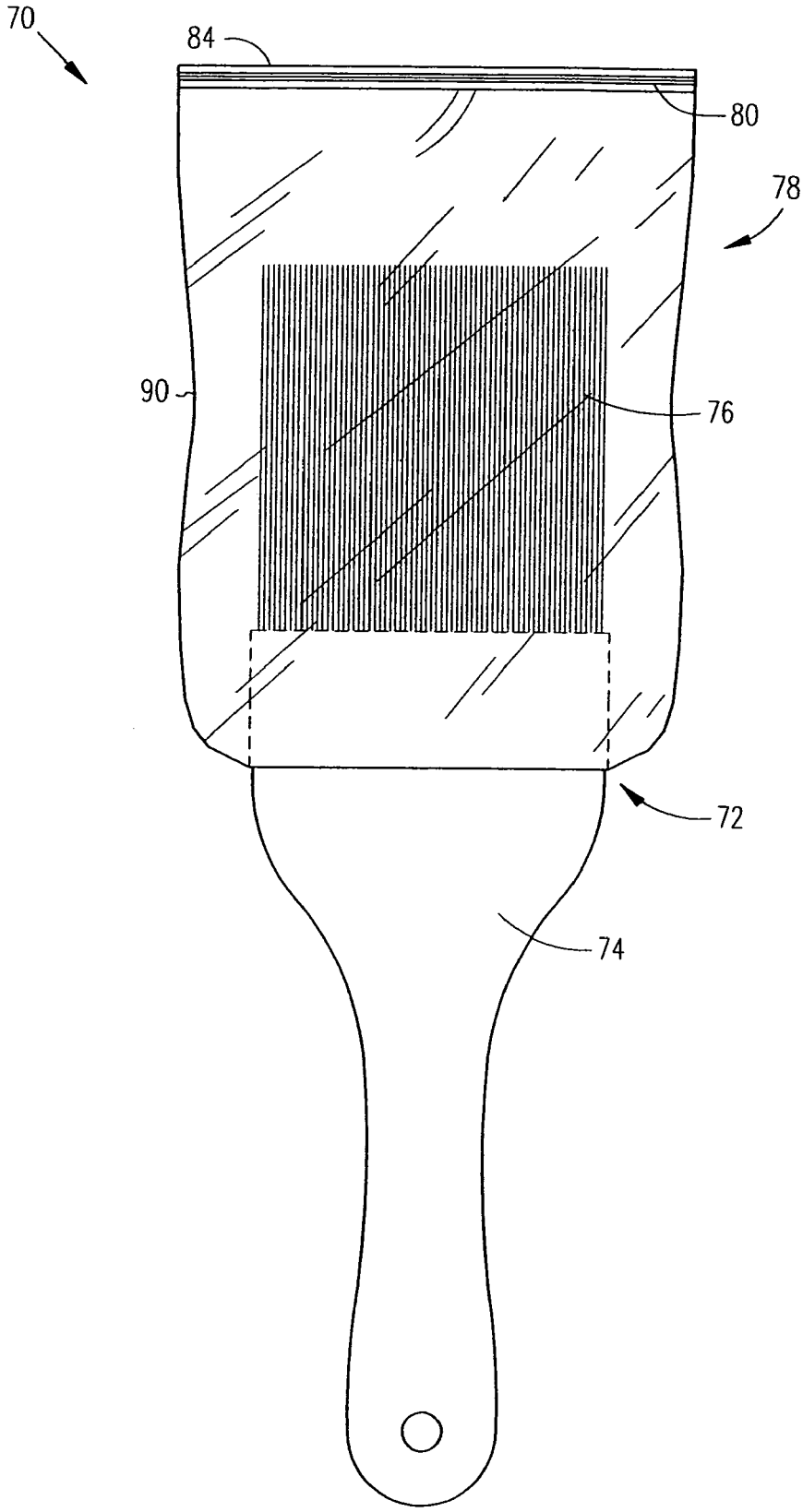
FIG. 10 is a perspective view of the apparatus shown in FIG. 9 with the cover on the apparatus back in the first position and a first layer of the cover removed.

In some embodiments, the cover 78 may be formed of a first layer 88 that is positioned adjacent to the transfer medium 76 when the cover 78 is in the first position (FIG. 8) and a second layer 90 that is positioned adjacent to the handle 74 when the cover 78 is in the second position (FIG. 9). In the illustrated example embodiment, the closure element 80 is part of the second layer 90. As shown in FIG. 10, the first layer 88 may be removed from the device 72 such that the second layer 90 is adjacent to the transfer medium 76 when the cover 78 is moved back in the first position.

When an operator uses the apparatus 70 to apply a liquid coating onto the object, the closure element 80 is moved to open the end 84 of the cover 78. The operator then moves the cover 78 to the second position so that the operator can apply a liquid coating onto the object using the transfer medium 76. As the operator applies the liquid coating to the object, the cover 78 protects the operator's hand.

If the operator decides to store the device 72 for disposal or later reuse, the operator moves the cover 78 back to the first position. The operator then moves the closure element 80 to close the end 84 of the cover 78 and thereby protect the transfer medium 76.

When the operator decides to reuse the apparatus 70, the operator moves the closure element 80 to open the end 84 of the cover 78. The operator then moves the cover 78 back to the second position and removes the messy first layer 88 such that the cover 78 again protects the operator's hand as the operator applies the liquid coating onto the object.

Once the operator finishes working the second time, the operator moves the cover 78 back to the first position such that second layer 90 is adjacent to the transfer medium 76. The operator then moves the closure element 80 to close the end 84 of the cover 78 thereby again protecting the transfer medium 76.

The operations discussed above may be performed in a different order from those described herein. In addition, FIGS. 1–9 are representational and are not necessarily drawn to scale. Certain proportions thereof may be exaggerated, while others may be minimized.

While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

We claim:

1. An apparatus for applying a liquid coating onto an object, the apparatus comprising:

a device that includes a handle and a transfer medium attached to the handle; and a cover attached to the device, the cover including an open end such that the cover is movable between a first position where the cover protects the transfer medium and a second position where the cover protects the handle, the cover being formed of a first layer that is positioned adjacent to the transfer medium when the cover is in the first position and a second layer that is positioned adjacent to the handle when the cover is in the second position, the first layer being removable such that the second layer is adjacent to the transfer medium when the cover is in the first position and the first layer is removed.

2. The apparatus of claim 1 wherein the transfer medium includes bristles.

3. The apparatus of claim 1 wherein the cover is attached to the device between the handle and the transfer medium.

4. The apparatus of claim 1 wherein the first and second layers of the cover are transparent to observe the condition of the transfer medium when the cover is in the first position.

5. The apparatus of claim 1 wherein the first and second layers of the cover are formed of a nonwoven laminate.

6. The apparatus of claim 1 wherein the first layer is formed of a first material and the second layer is formed of a second material, wherein the first material is the same as the second material.

7. An apparatus for applying a liquid coating onto an object, the apparatus comprising:

a device that includes a handle and a transfer medium attached to the handle; and a cover attached to the device, the cover including a closure element that is operable to open and close an end of the cover, the cover being movable when the end of the cover is open between a first position where the cover protects the transfer medium and a second position where the cover protects the handle, the cover being formed of a first layer that is positioned adjacent to the transfer medium when the cover is in the first position and a second layer that is positioned adjacent to the handle when the cover is in the second position, the first layer being removable such that the second layer is adjacent to the transfer medium when the cover is in the first position and the first layer is removed.

8. The apparatus of claim 7 wherein the transfer medium includes bristles.

9. The apparatus of claim 7 wherein the closure element is zipper lock.

10. The apparatus of claim 7 wherein the first layer is formed of a first material and the second layer is formed of a second material, wherein the first material is the same as the second material.

11. The apparatus of claim 7 wherein the cover is attached to the device between the handle and the transfer medium.

12. The apparatus of claim 7 wherein the first and second layers of the cover are transparent to observe the condition of the transfer medium when the cover is in the first position.

* * * * *